US006130656A

United States Patent [19]

Sugahara

[11] Patent Number: 6,130,656

[45] Date of Patent: Oct. 10, 2000

[54] ACTUATABLE FILM TYPE DISPLAY DEVICE

[75] Inventor: Atsushi Sugahara, Yokohama, Japan

[73] Assignee: Kabushiki Kaisha Toshiaba, Kawasaki, Japan

[21] Appl. No.: 08/939,839

[22] Filed: Sep. 29, 1997

[30] Foreign Application Priority Data

Sep. 30, 1996 [JP] Japan ..... 8-259520

[51] Int. Cl.[7] ..... G09G 3/34

[52] U.S. Cl. ..... 345/85; 345/84; 345/108; 359/296

[58] Field of Search ..... 345/85, 84, 107, 345/108, 81, 88, 86; 359/230, 290, 291

[56] References Cited

U.S. PATENT DOCUMENTS

| | | | |
|---|---|---|---|
| 3,897,997 | 8/1975 | Kalt | 350/161 |
| 4,336,536 | 6/1982 | Kalt et al. | 340/783 |
| 4,740,785 | 4/1988 | Stroomer et al. | 340/783 |
| 4,831,371 | 5/1989 | Hata | 340/783 |
| 5,638,084 | 6/1997 | Kalt | 345/31 |
| 5,943,033 | 8/1999 | Sugahara et al. | 345/85 |

FOREIGN PATENT DOCUMENTS 63-131174 6/1988 Japan .

*Primary Examiner*—Steven J. Saras
*Assistant Examiner*—Tewolde Mengisteab
*Attorney, Agent, or Firm*—Finnegan, Henderson, Farabow, Garrett & Dunner, L.L.P.

[57] ABSTRACT

An actuatable film type display device has a plurality of actuatable films. Each of the actuatable films is colored in a desired color and is put in or out of a gap between two white plates of adjacent pixels according to the driving control. The actuatable film is supported by a cantilever. An electrode (actuatable electrode) is attached to the cantilever. Further, two fixed electrodes are disposed to sandwich the cantilever. The actuatable electrode is moved closer to one of the fixed electrodes by a potential applied to the electrode on the cantilever, that is, the actuatable electrode and potentials applied to the fixed electrodes. The actuatable film, white plate, cantilever, and fixed electrodes are combined to constitute one pixel. A plurality of pixels thus formed are arranged in a matrix form to constitute a dot matrix display device.

24 Claims, 12 Drawing Sheets

ACTUATABLE FILM TYPE DISPLAY DEVICE

BACKGROUND OF THE INVENTION

This invention relates to an actuatable film type display device, and more particularly to an actuatable film type display device which can be driven without a refresh process and can be easily manufactured.

The entire contents of Japanese Patent Application No. 8-259520 filed on Sep. 30, 1996 are incorporated herein by reference.

Recently, it is required to reduce the weight and lower the power consumption of large-sized display devices and small-sized display devices which can be applied to portable equipments.

Conventionally, a display device disclosed in Jpn. Pat. Appln. KOKAI Publication No. 60-131174 is provided.

FIG. 1 shows a cross section of one pixel of a display device disclosed in the above Publication. Fixed electrodes 1, 2 are formed to have mirror-like surfaces, one side surface of a foil (actuatable portion) 3 is painted in white and the other side surface thereof is painted in black. The color of the exposed portion of the foil 3 is reflected on the opposite mirror surface, and the color of the exposed portion of the foil 3 and the color reflected on the mirror surface are observed by an eye 4 of a man. Since the foil 3 has an electrically conductive property and the foil can be attracted to one of the fixed electrodes depending on the potential thereof, the colors of the front and back surfaces of the foil can be selectively displayed by electrically changing the position of the foil 3.

However, the above display system cannot be applied to a color display system for three or more colors in principle, and even in a case of two-color display, the angle of visibility is small since the mirror-like surfaces are used, and it is difficult to attain clear display.

A driving circuit of the above display device has a construction shown in FIG. 2. In FIG. 2, a foil S is used as a signal line and applied with a potential 0 or E, and a fixed electrode F1 which is one of the fixed electrodes is used as a scanning line and applied with a potential 0 or 2E. The potential of the other fixed electrode F2 is commonly used for all of the pixels and the potential thereof is set to E or 2E.

The flow of control of the potentials of the electrodes is shown in FIG. 3. As shown in FIG. 4, in the above display system, cycles of (A) initialization, (B) re-painting of pattern, and (C) display of still picture are repeatedly effected.

However, in the above display system, the display screen is always set to a preset refresh display screen in the initialization step and continuous pictures cannot be displayed. That is, it is necessary to effect the refresh process for the entire display screen before writing and it is necessary to momentarily display the same picture on the entire display screen at the refreshing time, and there occurs a problem that continuous moving pictures cannot be displayed.

Further, the above display device cannot display three or more colors for one pixel. Even if two-color display is used, the angle of visibility is small since the mirror-like surfaces are used, and it is impossible to attain clear display.

BRIEF SUMMARY OF THE INVENTION

An object of this invention is to provide an actuatable film type display device which can effect a smooth moving picture display operation by the driving operation without effecting the refresh operation and which can be easily manufactured.

According to a first aspect of this invention, there is provided a display device comprising: a fixed portion having a first color; an actuatable portion having a second color; a supporting member for supporting the actuatable portion; first and second electrodes arranged with the supporting member disposed therebetween; and driving means for applying voltages to the supporting member and the first and second electrodes according to a video signal to generate electrostatic forces from the first and second electrodes with respect to the supporting member and deforming the supporting member to move the actuatable portion on the fixed portion according to the electrostatic force and display a desired color, wherein the driving means holds the displayed color by applying a reference voltage to the first and second electrodes and applying a voltage different from the reference voltage to the supporting member.

According to a second aspect of this invention, there is provided a display device comprising: a plurality of pixel portions arranged in a matrix form, each of the pixel portions including a fixed portion having a first color, an actuatable portion having a second color, a supporting member for supporting the actuatable portion, and first and second electrodes arranged with the supporting member disposed therebetween; a plurality of first scanning lines each of which is electrically connected to the first electrodes of those of the pixel portions which lie on a corresponding one of rows; a plurality of second scanning lines each of which is electrically connected to the second electrodes of those of the pixel portions which lie on a corresponding one of rows; a plurality of signal lines each of which is electrically connected to the supporting members of those of the pixel portions which lie on a corresponding one of columns; and driving means for applying voltages to the plurality of signal lines and the plurality of first and second scanning lines according to a video signal to generate electrostatic forces from the first and second electrodes with respect to the supporting members in the pixel portions and deforming the supporting members to move the actuatable portions on the fixed portions according to the electrostatic forces and display a desired video image, wherein the driving means holds the displayed video image by applying a reference voltage to the plurality of first and second scanning lines and applying a voltage different from the reference voltage to the plurality of signal lines.

According to a third aspect of this invention, there is provided a display device comprising: a plurality of pixel portions arranged in a matrix form, each of the pixel portions including a fixed portion having a first color, an actuatable portion having a second color, a supporting member for supporting the actuatable portion, and an electrode arranged near the supporting member; a plurality of scanning lines each of which is electrically connected to the electrodes of those of the pixel portions which lie on a corresponding one of rows; a plurality of signal lines each of which is electrically connected to the supporting members of those of the pixel portions which lie on a corresponding one of columns; and driving means for applying voltages to the plurality of signal lines and the plurality of scanning lines according to a video signal to generate electrostatic forces from the electrodes with respect to the supporting members in the pixel portions and deforming the supporting members to move the actuatable portions on the fixed portions according to the electrostatic forces and display a desired video image, wherein the driving means holds the displayed video image by applying a voltage $V_0$ to the plurality of scanning lines and applying one of the voltage $V_0$ and a voltage $-V_1$ to the plurality of signal lines in a case where the amount of deformation of the supporting member becomes maximum when the voltage $V_0$ is applied to the electrode and the voltage $2V_1$, is applied to the supporting member.

According to a fourth aspect of this invention, there is provided a display device comprising: a plurality of pixel portions arranged in a matrix form, each of the pixel portions including a fixed portion having a first color, an actuatable portion having a second color, a supporting member for supporting the actuatable portion, and first and second electrodes arranged with the supporting member disposed therebetween; a plurality of first scanning lines each of which is electrically connected to the first electrodes of those of the pixel portions which lie on a corresponding one of rows; a plurality of second scanning lines each of which is electrically connected to the second electrodes of those of the pixel portions which lie on a corresponding one of rows; a plurality of signal lines each of which is electrically connected to the supporting members of those of the pixel portions which lie on a corresponding one of columns; and driving means for applying voltages to the plurality of signal lines and the plurality of first and second scanning lines according to a video signal to generate electrostatic forces from the first and second electrodes with respect to the supporting members in the pixel portions and deforming the supporting members to move the actuatable portions on the fixed portions according to the electrostatic forces and display a desired video image, wherein the driving means holds the displayed video image by applying a voltage $V_0$ to the plurality of first and second scanning lines and applying one of voltages $V_1$ and $-V_1$ to the plurality of signal lines in a case where the amount of deformation of the supporting member becomes maximum when the voltage $V_0$ is applied to one of the first and second electrodes and the voltage $2V_1$ is applied to the supporting member.

According to this invention, two fixed electrodes are provided for each pixel unit and there is provided a bistable state in which the cantilever is stably held irrespective of the biased position of the cantilever in the holding state for uniformly holding the image, and therefore, a memory performance can be attained, no influence is given from another pixel and no crosstalk occurs. Further, since two fixed electrodes and two scanning lines are provided for each pixel and image information can be re-written for each scanning line unit, the refresh process for the entire display screen is not necessary and a smooth moving picture display operation can be attained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

There will now be described embodiments of this invention with reference to the accompanying drawings.

First, the first embodiment of this invention is explained.

Figure 1:
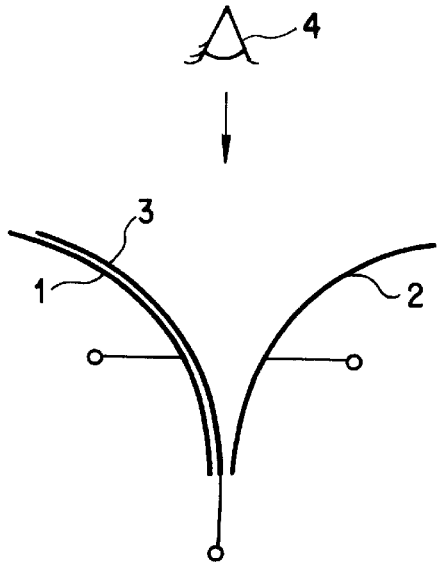
FIG. 1 (PRIOR ART)
FIG. 1 is a schematic view showing the structure of one pixel of a conventional display device using electrostatic force.
Figure 5:
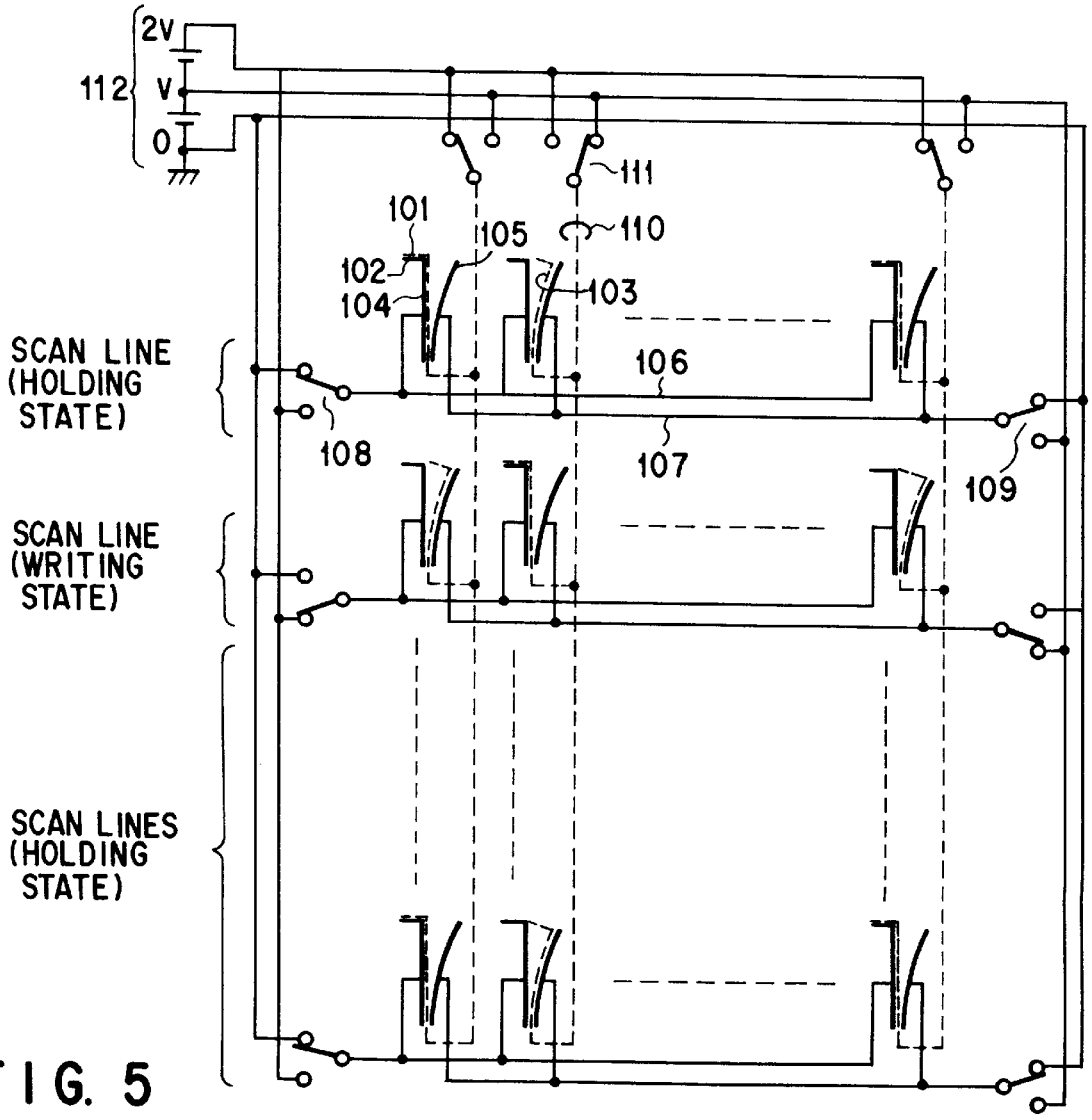
FIG. 5 is a connection diagram showing the circuit construction of an actuatable film type display device according to a first embodiment of this invention.
Figure 2:
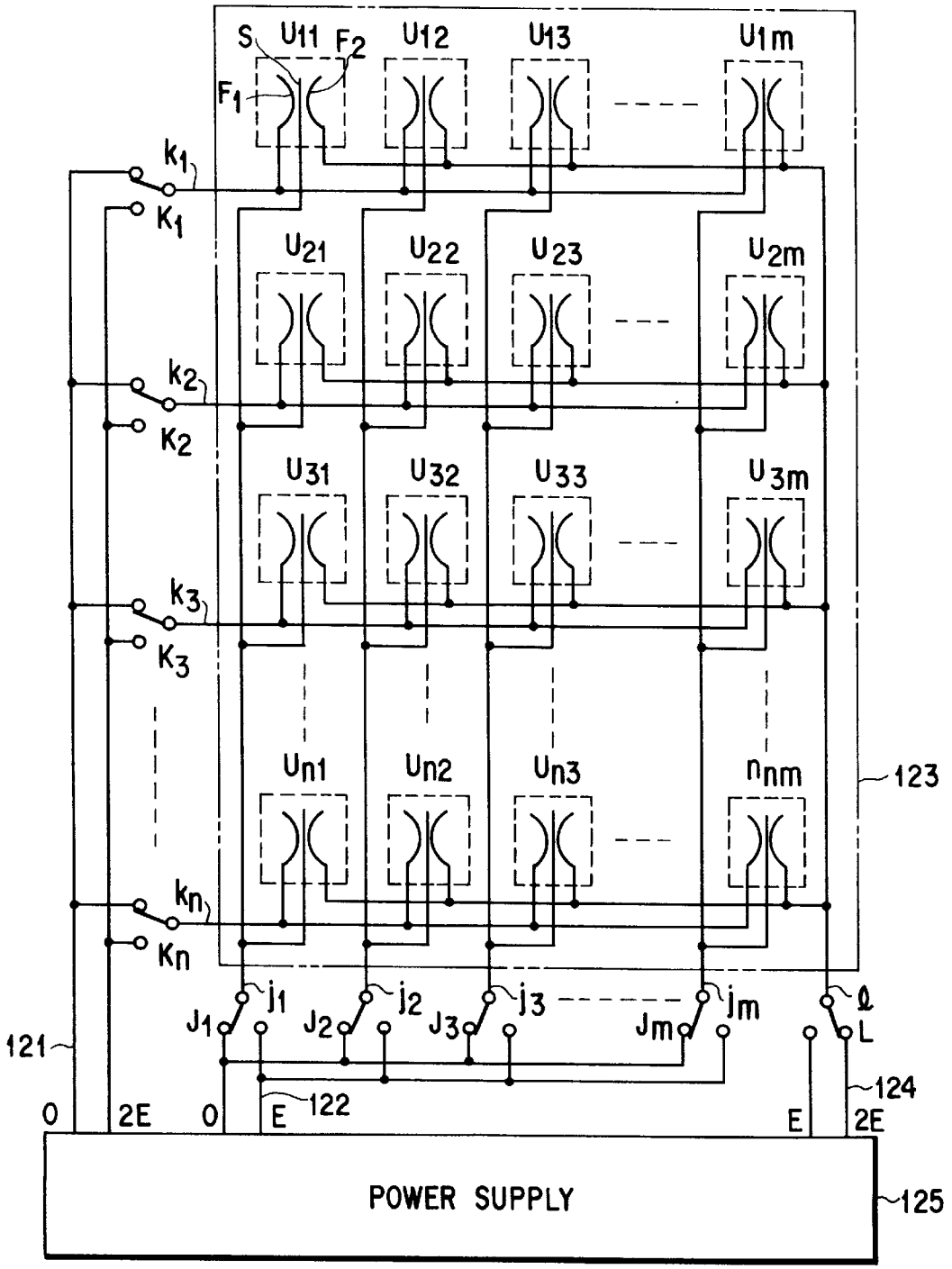
FIG. 2 (PRIOR ART)
FIG. 2 is a connection diagram for illustrating a driving circuit of a display device in which the pixel structure shown in FIG. 1 is used.
Figure 3:
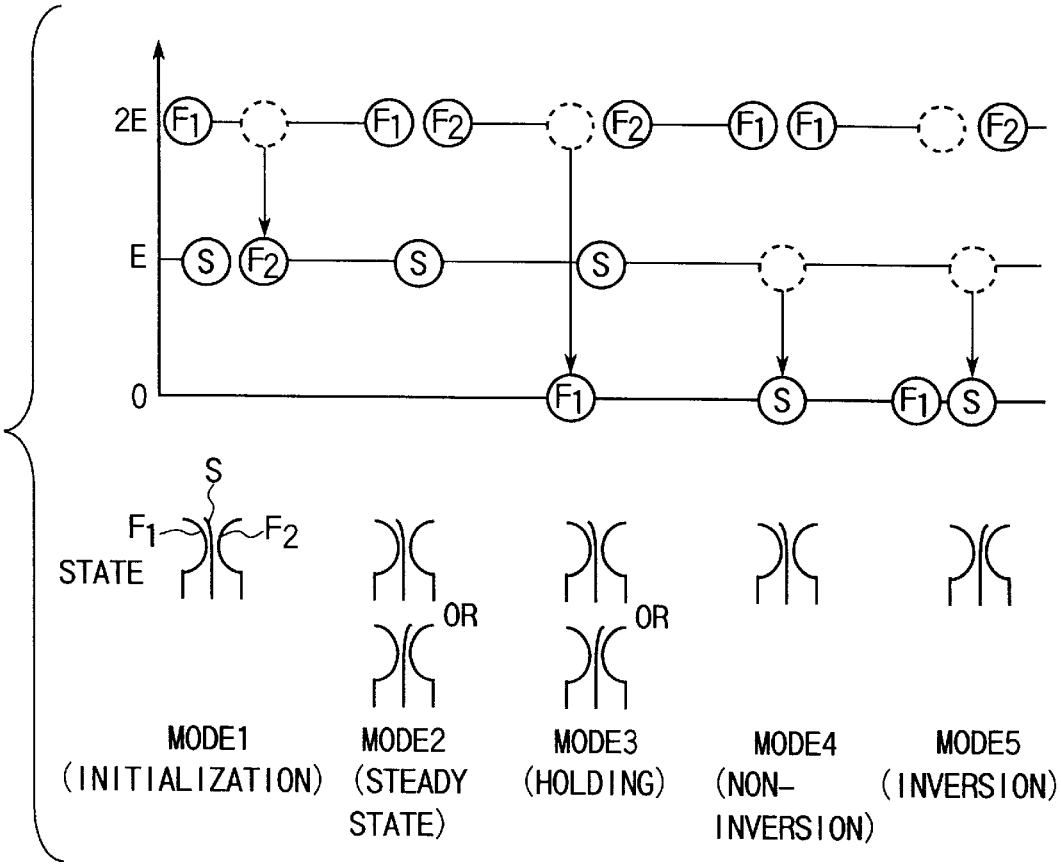
FIG. 3 (PRIOR ART)
FIG. 3 is a diagram for illustrating the driving process of the driving circuit shown in FIG. 2.
Figure 4:
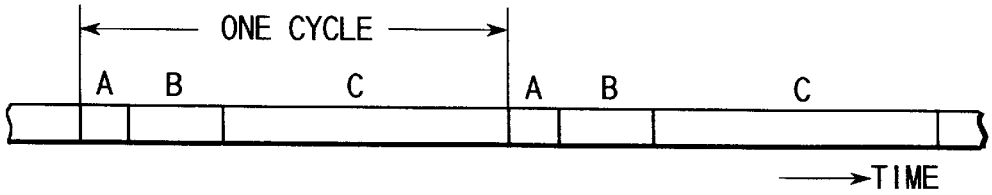
FIG. 4 (PRIOR ART)
FIG. 4 is a diagram showing the driving process of one cycle by the driving circuit shown in FIG. 2.

The circuit construction of an actuatable film type display device of this invention is shown in FIG. 5. The actuatable film type display device has a plurality of actuatable films 101. Each of the actuatable films 101 is painted in desired color and is put into or out of a gap between two white plates 102 of adjacent pixels according to the driving control. The actuatable film 101 is supported by a cantilever 103. An electrode (actuatable electrode) is attached to the cantilever 103. Further, fixed electrodes 104 and 105 are provided to sandwich the cantilever 103. The actuatable electrode is set closer to one of the fixed electrodes 104 and 105 according to a potential applied to the electrode on the cantilever 103, that is, the actuatable electrode and potentials applied to the two fixed electrodes.

The actuatable film 101, white plate 102, cantilever 103, fixed electrodes 104, 105 are combined to constitute one pixel. A plurality of pixels which are thus constructed are arranged in a matrix form to construct a dot matrix display device.

In this case, the actuatable electrodes on the cantilevers 103 arranged on the same column are connected to a corresponding one of signal lines 110 extending in a column direction of the matrix and the fixed electrodes 104, 105 arranged on the same row are connected to corresponding scanning lines 106, 107 extending in a row direction. The end of each signal line 110 is connected to a potential selecting switch 111 and the ends of the scanning lines 106, 107 are connected to potential selecting switches 108, 109. The potentials of the above wirings and electrodes can be set to 0, v, 2v according to a voltage supplied from a power source 112 (the small letter "v" indicates a specific potential and does not indicate the unit of voltage [volt]. This is also true in the following description). In this case, 2v indicates a potential equal to twice the potential v, but may be higher than twice the potential v.

In the circuit construction of FIG. 5, pixels arranged on the second row indicate the writing state in which information is received from the signal line 110, and the pixels on the other rows indicate the holding state in which the image information is held. The writing state and holding state will be described later.

Figure 6A:
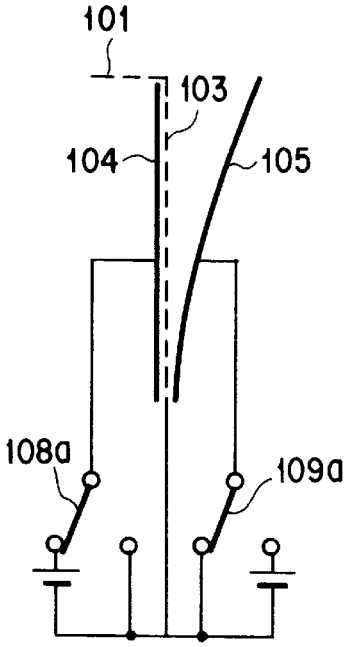
FIGS. 6A and 6B are views showing the structure of one pixel in the actuatable film type display device according to the first embodiment shown in FIG. 5.
Figure 6B:
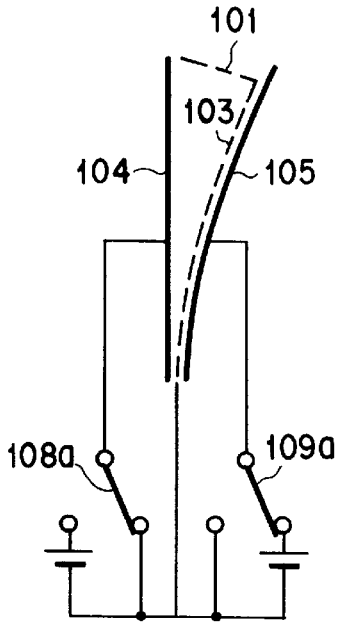

The cross sectional structure of one pixel in the display device is shown in FIGS. 6A and 6B. Insulating films are coated on the surfaces of the actuatable electrode and the fixed electrodes 104, 105 and the actuatable electrode will not be set closer to the fixed electrode within a distance equal to the thickness of the insulating film and is stopped at a preset distance from the fixed electrode.

FIG. 6A shows the cross sectional structure in a case where a potential difference is caused between the actuatable electrode and the fixed electrode 104 and the potentials of the actuatable electrode and the fixed electrode 105 are set to the same potential by controlling the switches 108*a*, 109*a*. In this case, the actuatable film is attracted towards the fixed electrode 104 by electrostatic force.

FIG. 6B shows the cross sectional structure in a case where a potential difference is caused between the actuatable electrode and the fixed electrode 105 and the potentials of the actuatable electrode and the fixed electrode 104 are set to the same potential by controlling the switches 108*a*, 109*a*. In this case, the actuatable film is attracted towards the fixed electrode 105 by electrostatic force.

Figure 7:
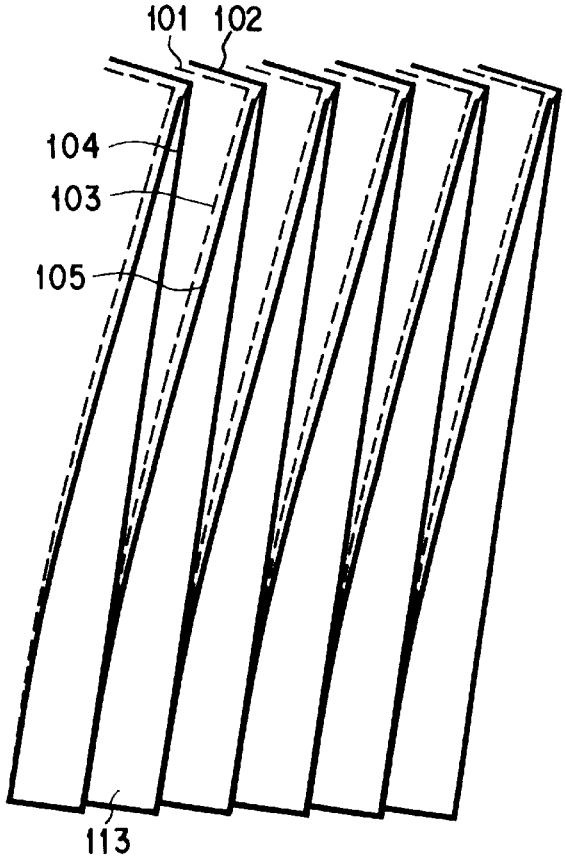
FIG. 7 is a view showing the structure of the cross section of the actuatable film type display device according to the first embodiment of this invention.

The cross sectional structure of the display device constructed by using the above principle is shown in FIG. 7. The display device has such a structure that the colored actuatable film 101 is put into or out of a gap between white plates 102 arranged in a roofing tile form. The display color of the display device is determined by the color of the actuatable film 101 and the color of the white plate 102. It is possible to use a plate which is painted in a preset color other than white instead of the white plate. The fixed electrodes 104, 105 can be attached to the supporting body 113 for the fixed electrode, and in this case, the assembling process can be simplified.

Figure 8:
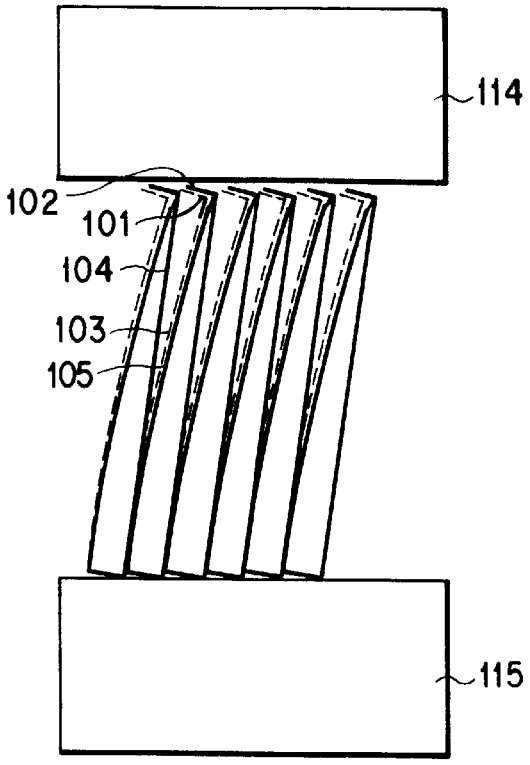
FIG. 8 is a view showing the structure of the cross section of the actuatable film type display device according to the first embodiment of this invention.

In practice, the actuatable film 101, white plate 102, actuatable electrode, fixed electrodes 104, 105 are disposed between a transparent cover 114 and a substrate 115 as shown in FIG. 8 and are protected from mechanical shock from the exterior.

Figure 9:
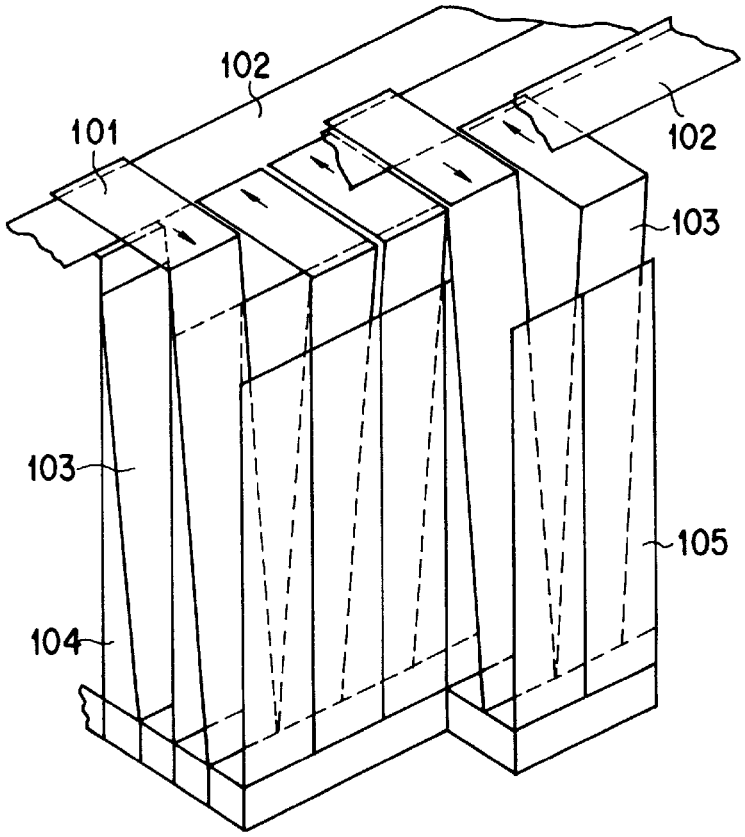
FIG. 9 is a perspective view showing part of the actuatable film type display device of two-color display type according to the first embodiment of this invention.
Figure 10:
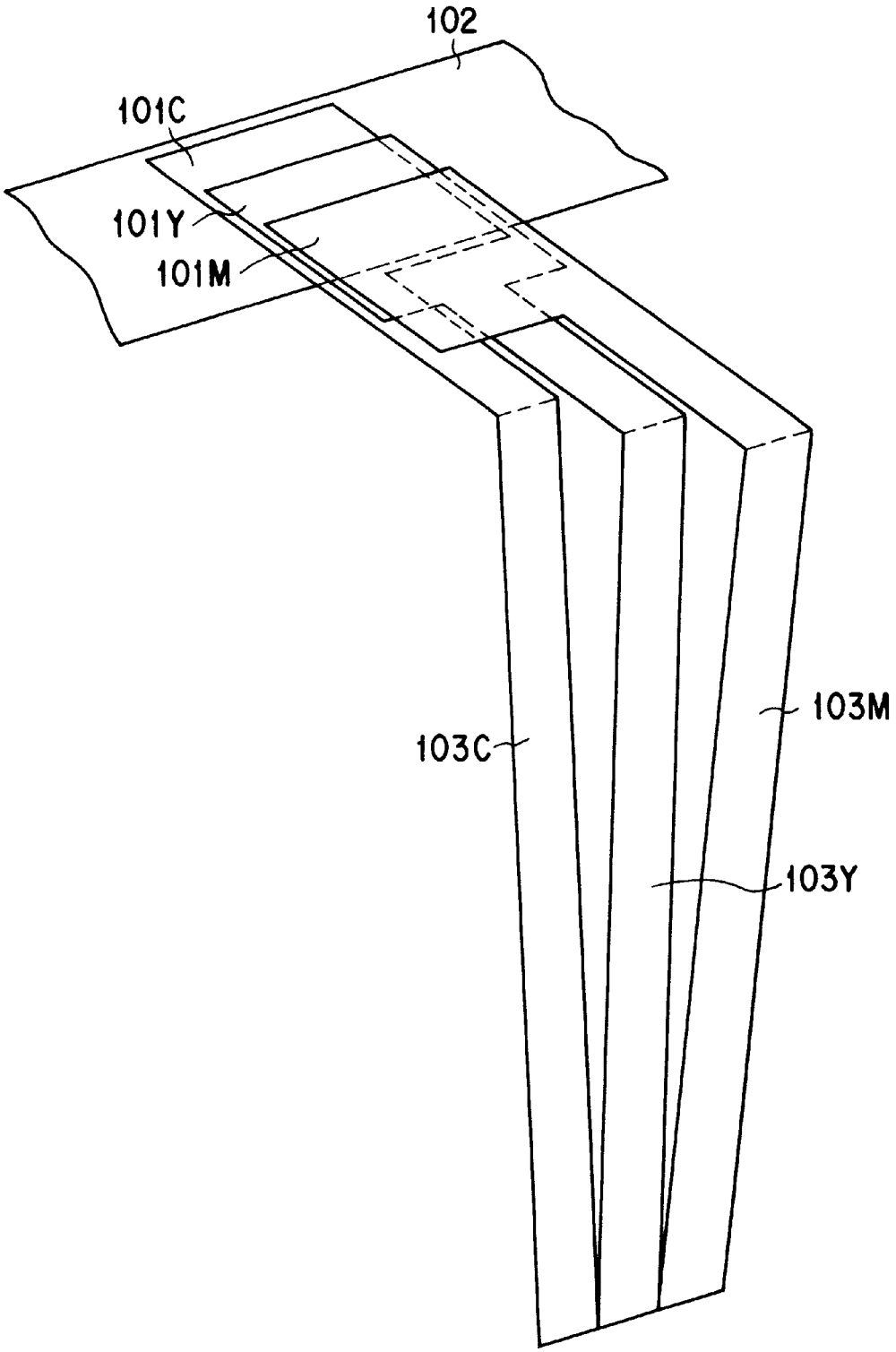
FIG. 10 is a perspective view showing part of the actuatable film type display device of color display type according to the first embodiment of this invention.

FIG. 9 is a perspective view showing part of the display device for two-color display based on the above principle, and FIG. 10 shows a display device for eight-color display. As shown in FIG. 10, an actuatable film 101C which is transparent and colored in cyan, an actuatable film 101Y which is transparent and colored in yellow, and an actuatable film 101M which is transparent and colored in magenta are laminated on a white plate.

As shown in FIG. 10, the actuatable films 101C, 101Y, 101M can be moved independently. When black is displayed, all of the actuatable films 101C, 101Y, 101M are set on the white plate, and when white is displayed, all of the actuatable films are set or concealed under the white plate of an adjacent pixel. When red is displayed, the actuatable films 101Y, 101M are set on the white plate 102 and the actuatable film 101C is concealed. When blue is displayed, the actuatable films 101C, 101M are set on the white plate and the actuatable film 101Y is concealed. When green is displayed, the actuatable films 101C, 101Y are set on the white plate 102 and the actuatable film 101M is concealed.

Thus, basic eight colors can be displayed, and in addition, neutral colors can be displayed by adjusting the amounts by which the colored actuatable films are placed on the white plate.

Next, the reason why the effect and operation of this invention can be attained by use of the circuit construction of FIG. 5 is explained. In the first embodiment, the cantilever 103 of one pixel has a bistable property having two stable states. This indicates that a memory performance is provided and the power consumption becomes "0" when a still picture is displayed and extremely low power consumption can be attained. Further, occurrence of crosstalk which is an influence from another pixel can be prevented.

The bistable property is explained with reference to FIGS. 11A to 11F.

Figure 11A:
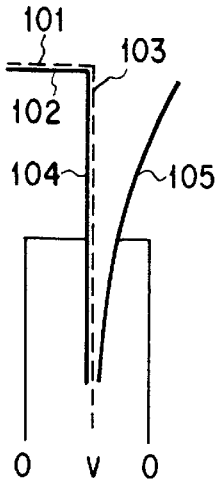
FIGS. 11A to 11F are diagrams for illustrating the principle of the operation of each pixel of the display device of the first embodiment.
Figure 11D:
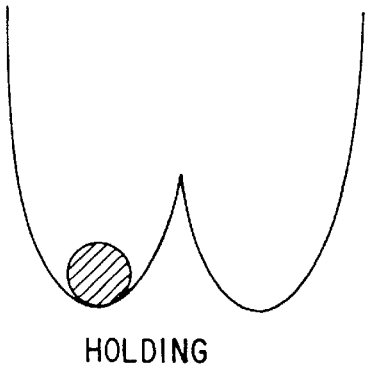

In the case of FIG. 11A, the potential of the fixed electrode 104 is set to "0", the potential of the fixed electrode 105 is set to "0", and the potential of the actuatable electrode on the cantilever 103 is set to v. Since the electrostatic attraction force varies with the reciprocal of the square of a distance, the actuatable electrode is attracted towards a closer one of the fixed electrodes even when the potentials of the two fixed electrodes are set equal to each other. This phenomenon is independent from the potential v of the actuatable electrode. In the state shown in FIG. 11A, the actuatable electrode is attracted towards the fixed electrode 104 irrespective of the potential of the actuatable electrode. However, in order to cause the phenomenon, it is required to set the influence of the elastic stress of the cantilever 103 extremely smaller than the electrostatic force. Since the state shown in FIG. 11A is constant irrespective of the potential of the actuatable electrode, it is called a holding state. The concept of the holding state is shown in FIG. 11D.

Figure 11B:
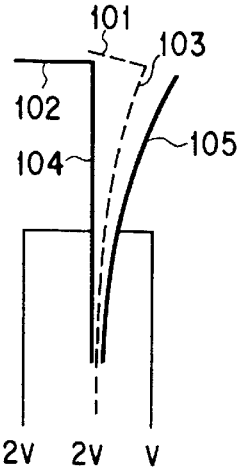
Figure 11E:
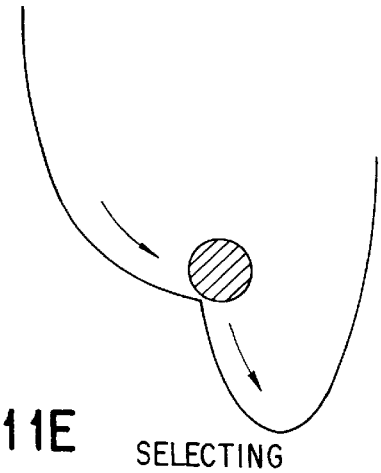
Figure 11C:
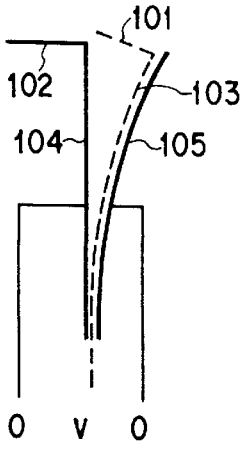
Figure 11F:
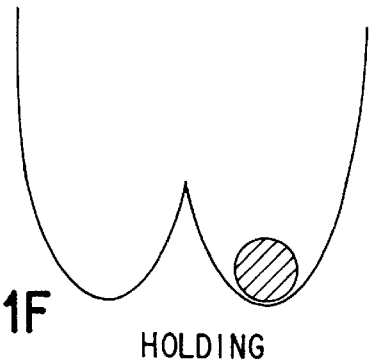

In the case of FIG. 11B, the potential of the fixed electrode 104 is set to 2v, the potential of the fixed electrode 105 is set to v, and thus the potentials of the two fixed electrodes are set to different values. In this case, one of the two fixed electrodes to which the actuatable electrode is attracted is determined according to the potential of the actuatable electrode. That is, the state shown in FIG. 11B is a state in which the image state is changed according to the potential of the actuatable electrode and it is called a selecting state. In the example shown in FIG. 11B, since the potential of the actuatable electrode is set to 2v, the cantilever 103 is moved towards the fixed electrode 105. The concept of the selecting state is shown in FIG. 11E. If the potential state shown in FIG. 11C is set after the selecting state shown in FIG. 11B, the holding state is set again. The potential state shown in FIG. 11C is exactly the same as the potential state shown in FIG. 11A, but the position of the cantilever 103 is set on the fixed electrode 105 side. The concept of the holding state is shown in FIG. 11F.

Thus, each of the pixels of the display device has a bistable state including a state in which the cantilever 103 is stably set on the fixed electrode 104 side as shown in FIG. 11A and a state in which the cantilever 103 is stably set on the fixed electrode 105 side as shown in FIG. 11C.

Figure 12:
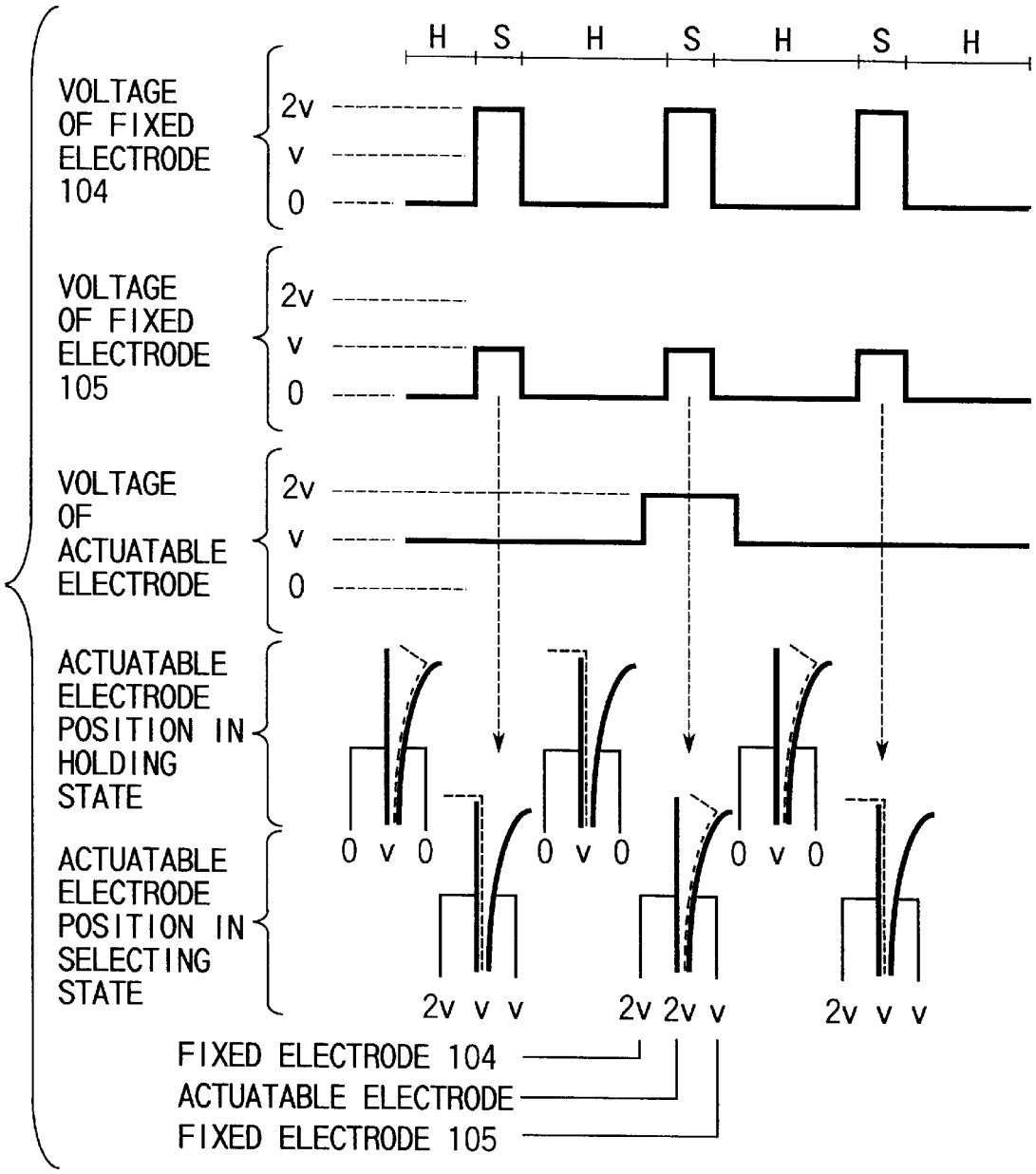
FIG. 12 is a diagram for illustrating the driving process of the display device of the first embodiment.

Next, the driving method of the first embodiment is explained according to the timing chart shown in FIG. 12. In FIG. 12, "H" indicates the holding state and "S" indicates the selecting state.

In the potential state of each of the pixels, the holding state and the writing state repeatedly occur. In the case of FIG. 12, the potential of the fixed electrode 104 is set to "0" in the holding state and set to 2v in the selecting state. The potential of the fixed electrode 105 is set to "0" in the holding state and set to v in the selecting state. Further, the potential of the actuatable electrode can be set to any potential in the holding state, and if it is set to 2v in the selecting state, the cantilever 103 having the actuatable electrode attached thereto moves towards the fixed electrode 105, and if it is set to v, the cantilever 103 moves towards the fixed electrode 104. Thus, desired image information can be written into and held in each pixel.

Next, a method for manufacturing the actuatable film type display device of the first embodiment is explained.

Figure 13:
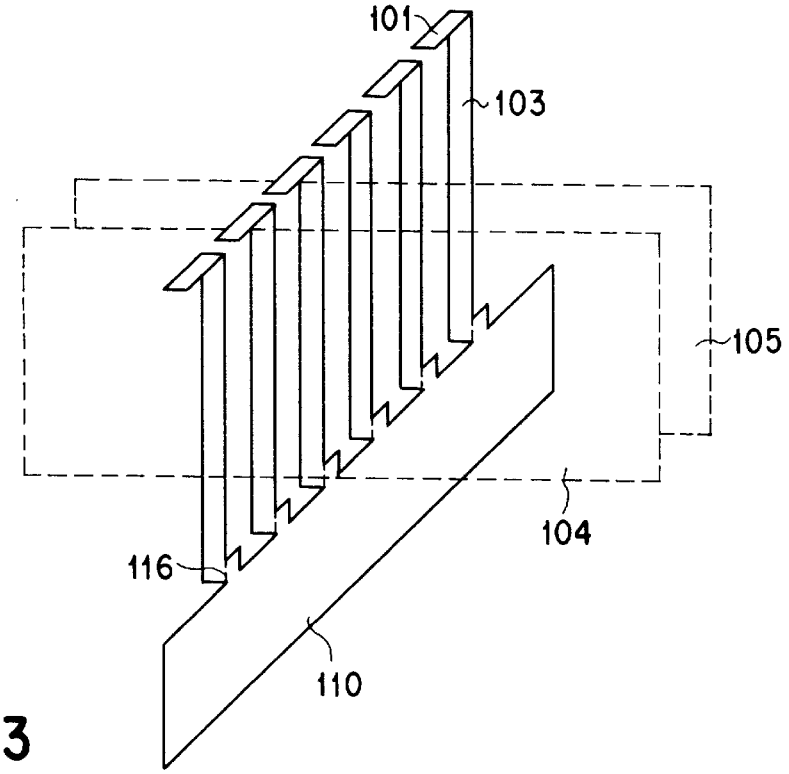
FIG. 13 is a view showing the structure of a pixel portion of the display device of the first embodiment.

As shown in FIG. 13, the actuatable film 101, the cantilever 103 having the actuatable electrode and the signal line 110 are formed of the same material, that is, an electrically conductive film. The cantilever 103 is bent at a bending portion 116 such that a direction normal to the surface of the cantilever 103 will intersect at right angles with a direction normal to the surface of the signal line 110. With this structure, it becomes unnecessary to connect the cantilever 103 for each pixel and the manufacturing yield is significantly enhanced.

Next, a method for forming the structure of the cantilever 103 is explained.

Figure 14:
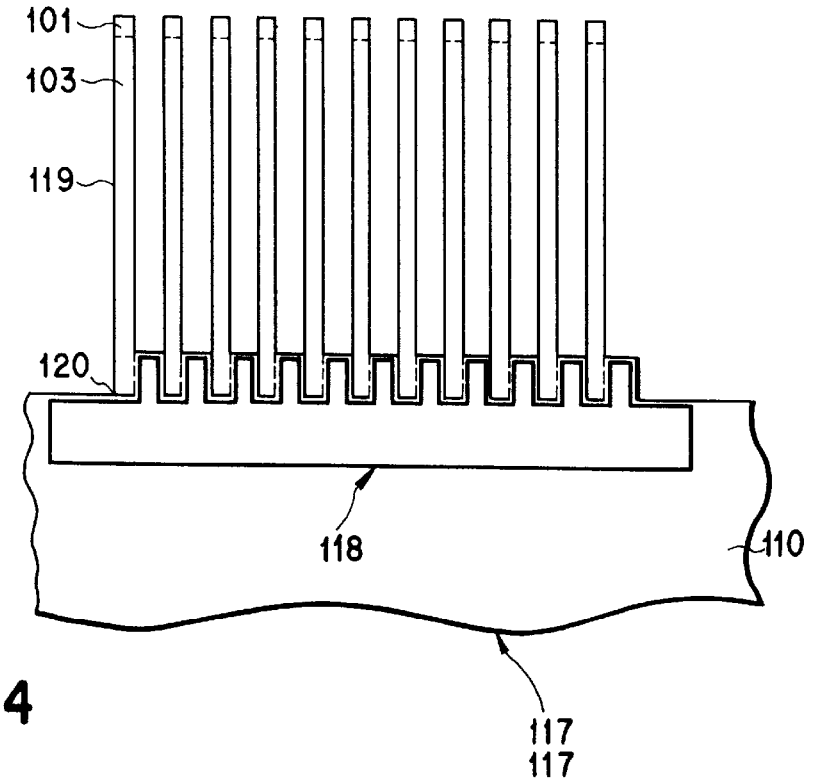
FIG. 14 is a view for illustrating a method for manufacturing the display device of the first embodiment.

As shown in FIG. 14, a rigid bottom supporting body 18 is adhered to an electrically conductive film 117 and the electrically conductive film is cut along a line 119 by use of a laser beam. In FIG. 14, broken lines indicate bending portions and the portions are half-cut. Further, slits are made in slit portions 120 so that the cantilever can be bent at the portion indicated by the broken lines.

Thus, the cantilever 103 can be bent at right angles with respect to the bottom supporting body. Further, the actuatable film 101 is formed of a material equivalent to the material of the cantilever 103 and is formed by bending the cantilever. However, a portion of the actuatable film 101 is not necessarily formed of the same material and can be formed of a different material and connected to the cantilever in the later step.

Figure 15:
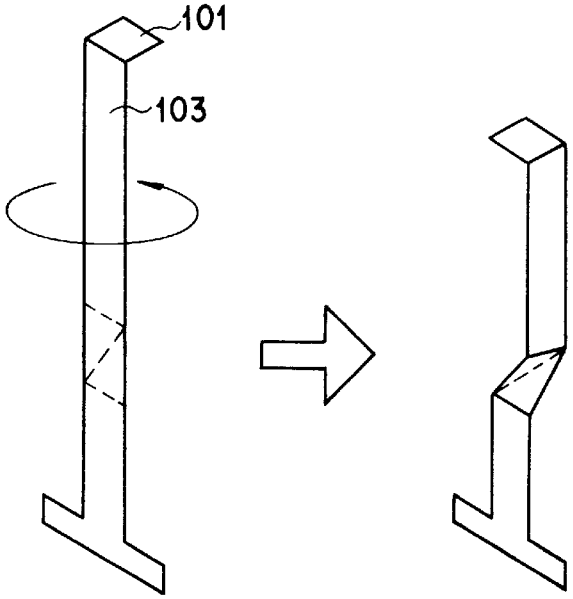
FIG. 15 is a view for illustrating a method for manufacturing the display device of the first embodiment.

In a portion in which the cantilever 103 and the bottom supporting body 118 are bent at right angles, it is not always necessary to bend the cantilever after the slit is made, and as shown in FIG. 15, the cantilever 103 may be bent after it is creased.

In order to apply potentials to the signal line 110 and scanning lines 106, 107 (FIG. 5) of FIG. 14, it is necessary to connect a driver IC to the peripheral portion of the display device. Although not shown in the drawing, the end portions of the electrodes are slightly bent so as to be connected to the driver IC.

Next, the concrete dimensions and material of the first embodiment are explained.

The display device of this invention can be applied to various devices ranging from an information terminal device of super high definition to a large-sized display used as a signboard or advertising tower. Therefore, the size of one pixel ranges from 30 microns to 3 cm and is not particularly limited. As one example, a case wherein the pixel pitch is 100 microns is explained.

In a case wherein the pixel pitch is 100 microns, the size of the colored actuatable film 101 for one pixel is 100 microns square and the size of the white plate 102 is also 100 microns square. In this case, the thickness of the cantilever 103 is preferably 2 to 12 microns and the length thereof is preferably approx. 1 mm. If the length of the cantilever 103 is increased, a change in the angle of movement of the actuatable film is reduced and it is preferable because the irregularity of the display screen is reduced. As the cantilever is made longer, the top end of the cantilever can be more displaced by a lower application voltage, and therefore, it is preferable to increase the length of the cantilever. As a standard value of the length of the cantilever, the length may be set to approx. 10 times the pixel pitch, but if the length is set to an excessively large value, it is not preferable because the whole thickness of the display device becomes excessively large.

Next, a case wherein a PET (polyethylene terephthalate) film formed by using PET (polyethylene terephthalate) as the material of the cantilever and depositing aluminum to a thickness of 300 to 500 angstrom on the surface of the cantilever is used is explained. It is proved from experiments that, as described before, if the length of the cantilever is set to 1 mm and the thickness thereof is set to 4.5 microns, the top displacement becomes 100 microns by an application voltage of 10 volts and the pixel can effect the binary display.

The power consumption at this time is calculated. The power consumption P is represented by $P=nCV^2f$. In this equation, n indicates the number of pixels, C indicates the electrostatic capacity of one pixel, V indicates an application voltage, and f indicates a frequency (the number of display screens for each second). The electrostatic capacity C of one pixel can be calculated as follows.

$$C=8.85\times10^{-12}\times4\times10^{-3}\times100^{-6}/4.5\times10^{-6}=7.87\times10^{-13}[F]$$

In this case, the dielectric constant of vacuum is set to $(8.85\times10^{-12})$, PET is used for the insulating film, the relative dielectric constant is 4, the area of the cantilever is $(10^{-3}\times100\times10^{-6})m^2$, and the thickness of the insulating film is set to $(4.5\times10^{-6})m$.

Assuming that the number of pixels is 640×480, the voltage is 10 volts, and moving pictures of 30 frames for each second are displayed (the white/black display on the entire display screen is switched 30 times for each second), then the power consumption P is derived as follows.

$$P=640\times480\times7.87\times10^{-12}\times10\times10\times30=7.25\times10^{-3}[W]$$

In the above calculation, the fixed electrode of the pixel in the holding state is set at an electrically floating potential.

It is understood that no crosstalk occurs for all of the image patterns even if the potential of the fixed electrode is set at the electrically floating potential in the holding state by previously setting the potentials of the two fixed electrodes at the time of writing to v and 3v.

As described above, according to the first embodiment, two fixed electrodes are provided for each pixel unit and there is provided a bistable state in which the cantilever is stably held irrespective of the biased position of the cantilever in the holding state for uniformly holding the image, and therefore, the memory performance can be attained, no influence is received from another pixel and no crosstalk occurs. Further, since two fixed electrodes and two scanning lines are provided for each pixel and image information can be re-written for each scanning line unit, the refresh process for the entire display screen is not necessary and a smooth moving picture display operation can be attained.

Further, since the cantilever is formed integrally with the signal line, it is not necessary to make a connection for each pixel and the manufacturing yield is enhanced. In addition, since the etching process becomes unnecessary, the manufacturing yield is enhanced.

The above power consumption is lower by approx. two figures in comparison with the power consumption of a liquid crystal display device with back light. Further, the above power consumption is equivalent to or lower by one figure in comparison with the power consumption of a reflection type liquid crystal display device.

In the first embodiment, in principle, in the still image display state, the power consumption is "0". In the liquid crystal display system, since it is necessary to apply an AC electric field to the liquid crystal material even in the still image display state, the power consumption is not "0". Further, in the liquid crystal display system, bright reflection type display cannot be attained. That is, in the first embodiment, a display device which is higher in image quality and lower in power consumption than the liquid crystal display system can be provided.

Next, a second embodiment of this invention is explained.

Figure 16A:
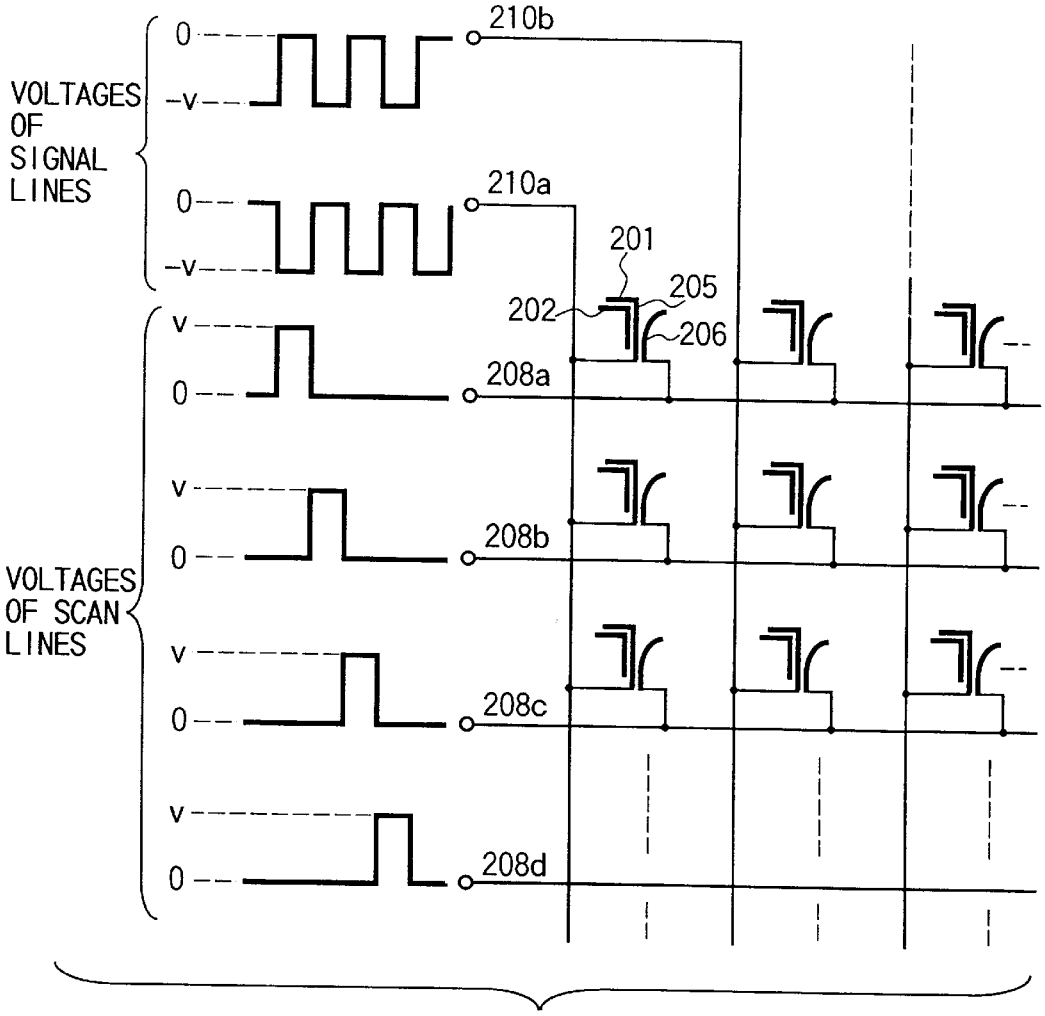
FIGS. 16A and 16B are diagrams showing the relation between a matrix circuit and the potential waveforms in the circuit of the display device according to a second embodiment of this invention.

Like the first embodiment, the second embodiment is a device for displaying desired information by putting a colored actuatable film 201 into or out of a gap between the white plates 202. A matrix circuit relating to the display device of the second embodiment and potential waveforms are shown in FIG. 16A. An actuatable film 201 is attached to the top end of a cantilever 205. A conductive film is coated as an actuatable electrode on the surface of the cantilever 205. Therefore, the amount of distortion of the cantilever 205 is controlled according to an electric field created by the fixed electrode 206. Further, an insulating film is coated on the surface of the fixed electrode 206 or the actuatable electrode so as to prevent the cantilever 205 from being electrically short-circuited to the fixed electrode 206 even if they are brought into contact with each other.

The actuatable electrode on the surface of the cantilever 205 is electrically connected to a corresponding one of signal lines 210 (210*a*, 210*b*, - - - ). Further, the fixed electrode 206 is electrically connected to a corresponding one of scanning lines 208 (208*a*, 208*b*, - - - ).

Figure 16B:
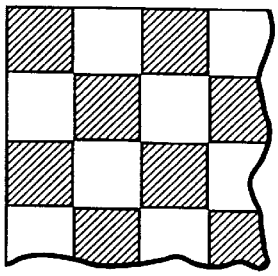

The potential of the scanning line is set to "0" (GND) at the non-selection time and set to a preset potential v only at the selected time. The potential of the signal line can be selectively set to "0" (GND) and a preset potential –v and is selectively set to one of the potentials according to video information. In the example shown in FIG. 16A, a checker flag pattern as shown in FIG. 16B is displayed.

Next, the principle of the driving operation of the display device of the second embodiment is explained.

Figure 17:
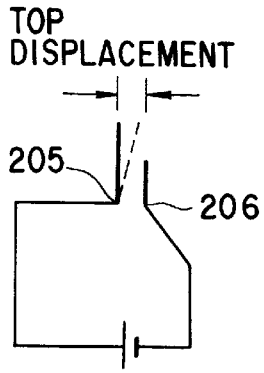
FIG. 17 is a connection diagram for measuring the hysteresis characteristic of one pixel in the display device of the second embodiment.

A voltage is applied between the cantilever 205 and the fixed electrode 206 as shown in FIG. 17. As described before the cantilever 205 has an actuatable electrode attached thereto and an insulating film is disposed between the cantilever and the fixed electrode 206.

Figure 18:
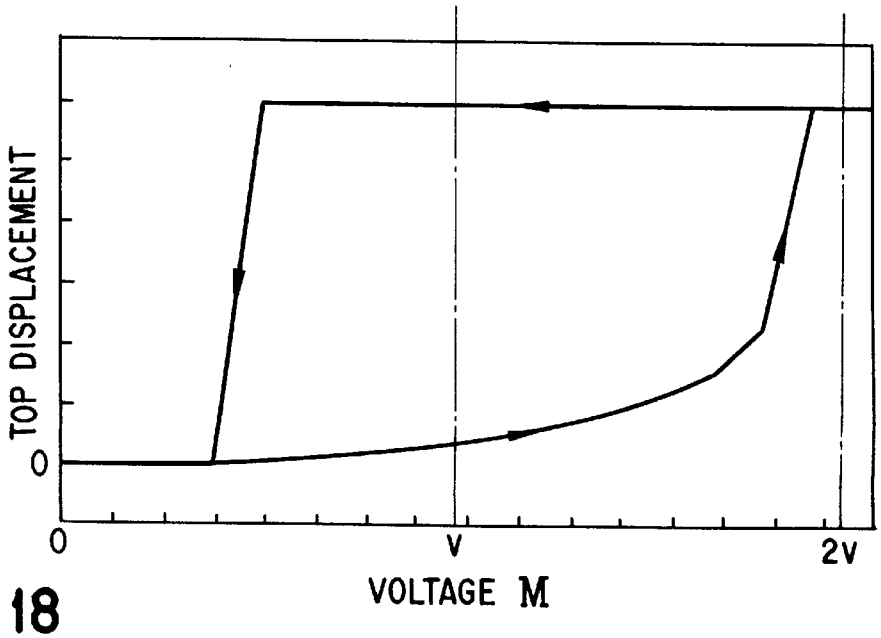
FIG. 18 is a graph showing the hysteresis characteristic of one pixel in the display device of the second embodiment.

Next, refer to FIG. 18. FIG. 18 is a graph in which the abscissa indicates an application voltage and the ordinate indicates the top displacement of the cantilever 205. As is clearly seen from FIG. 18, there occurs a hysteresis phenomenon. That is, the dependency of the top displacement on the voltage is different in the voltage increasing direction and in the voltage lowering direction. This is because the electrostatic force inversely varies with the square of the distance between the electrodes. As the voltage rises, the distance between the electrodes becomes shorter, the electrostatic force becomes stronger and finally the cantilever 205 and the fixed electrode 206 are substantially brought into contact with each other with the insulating film disposed therebetween. Once they are set in contact with each other, the contact state is maintained even if the voltage is lowered since the distance between the electrodes is short, and when a certain potential is reached, that is, when the elastic stress of the cantilever 205 overcomes the electrostatic force, the cantilever 205 is separated from the fixed electrode 206. This causes the hysteresis.

The second embodiment is based on the above phenomenon. Selection/non-selection of information for each pixel can be made by use of the hysteresis and the memory effect of the image information can be attained.

The second embodiment is explained with reference to FIG. 16A. Only when the potential of the scanning line 208 is set to v and the potential of the signal line 210 is set to –v, the potential difference between the actuatable electrode and the fixed electrode 206 becomes 2v and the actuatable electrode can be moved. When the potential difference is v, information is held and new information cannot be written. Thus, if the potential of the scanning line is set to v, the pixels arranged on the scanning line are set into the selected state and new information can be written. At this time, the pixels arranged on the scanning line whose potential is set at "0" (GND) maintain the present state irrespective of the potentials of the signal lines.

By realizing the display device based on the above operation principle, the same effect as that of the first embodiment can be attained.

Next, a third embodiment of this invention is explained.

Figure 19A:
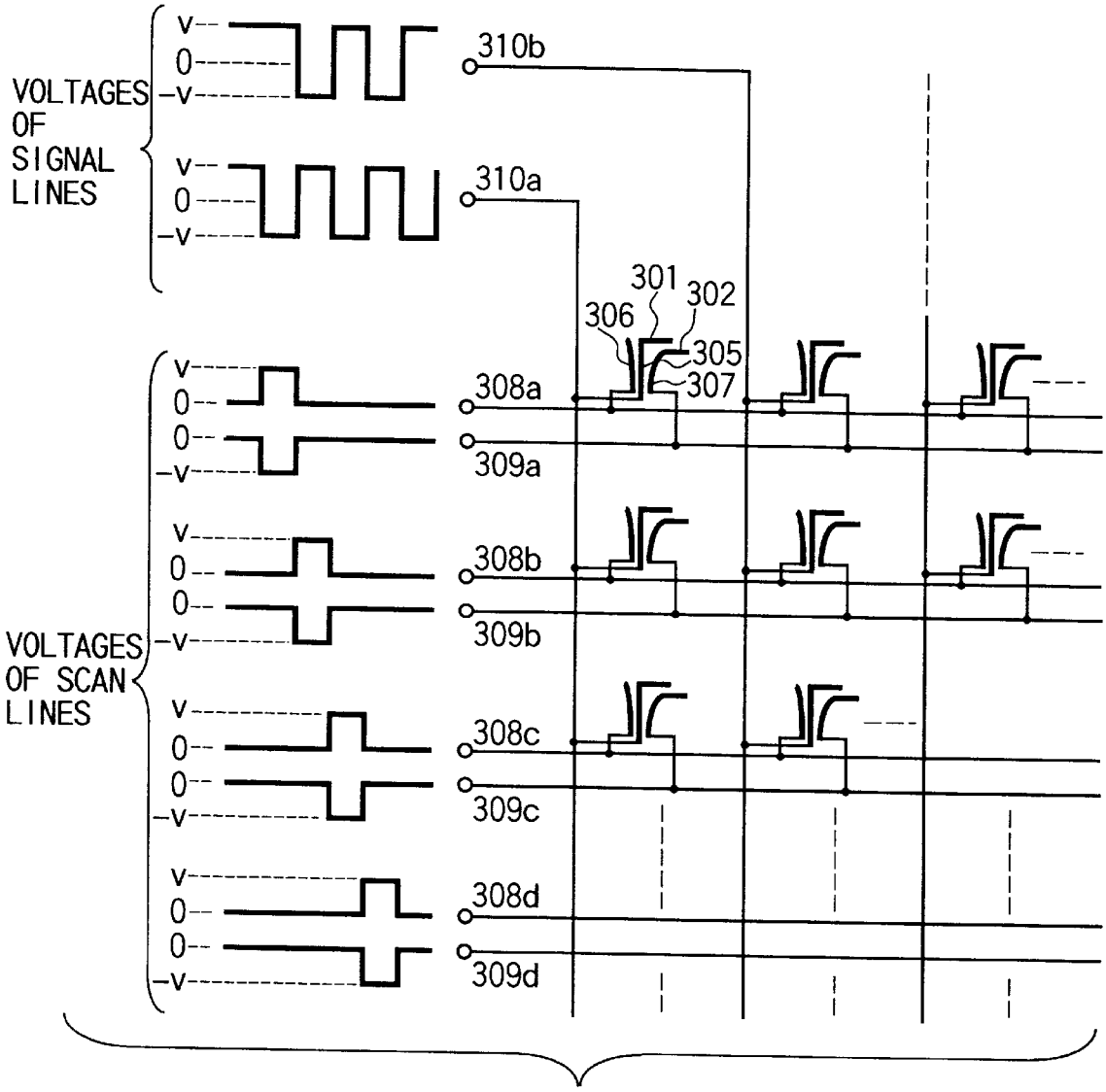
FIGS. 19A and 19B are diagrams showing the relation between a matrix circuit and the potential waveforms in the circuit of the display device according to a third embodiment of this invention.

Like the first and second embodiments, the third embodiment is a display device for displaying desired information by putting a colored actuatable film 301 into or out of a gap between the white plates 302. In the third embodiment, as shown in FIG. 19A, two fixed electrodes 306, 307 are provided for one cantilever 305. The feature of the third embodiment is that electrostatic forces are separately acted in different directions on the cantilever 305. That is, in the second embodiment, the elastic stress of the cantilever is utilized to separate the actuatable electrode from the fixed electrode, but in the third embodiment, the electrostatic force is additionally used.

The fixed electrodes 306, 307 are separately and electrically connected to scanning lines 308, 309 (308*a*, 308*b*, - - - , 309*a*, 309*b*, - - - ). Further, the actuatable electrode on the cantilever 305 is connected to a corresponding signal line 310 (310*a*, 310*b*, - - - ). That is, each pixel is connected to two scanning lines and one signal line.

Figure 19B:
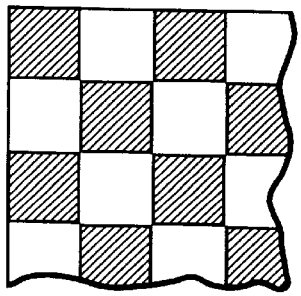

The potentials of both of the scanning lines are set to "0" (GND) at the non-selection time and set to preset potentials v and –v only at the selected time. The potential of the signal line can be selectively set to the two potentials of −v and v and is selectively set to one of the potentials according to video information. FIG. 19A shows an example in which a checker flag pattern shown in FIG. 19B is displayed.

Next, the principle of the driving operation of the above display device is explained.

Like the second embodiment, the third embodiment utilizes the hysteresis phenomenon. Since both of the fixed electrodes are set to the same potential of "0" (GND) at the non-selection time, the potential difference between the fixed electrode and the signal line becomes v irrespective of the potential of the signal line, and therefore, two stable states can be set up based on the hysteresis phenomenon and the cantilever 305 will not move. That is, the holding state explained in the first embodiment is set up. The potential of one of the fixed electrodes is set to −v and the potential of the other fixed electrode is set to v at the selected time. Since the potential of the signal line, that is, the potential of the actuatable electrode is set to −v or v, the actuatable electrode is attracted to one of the fixed electrodes whose potential has an opposite polarity.

By realizing the display device based on the above operation principle, the same effect as that of the first embodiment can be attained.

In the second and third embodiments, the method for forming the cantilever as explained in the first embodiment can be applied.

Further, the white plate 102 is formed only on the fixed electrode 104 in the case of FIG. 5, but it is possible to form a white plate 102 also on the other fixed electrode 105.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display device comprising:

a fixed portion having a first color;

an actuatable portion having a second color;

a supporting member for supporting said actuatable portion;

first and second electrodes arranged with said supporting member disposed therebetween; and driving means for applying voltages to said supporting member and said first and second electrodes according to a video signal to generate electrostatic forces from said first and second electrodes with respect to said supporting member and deforming said supporting member to move said actuatable portion on said fixed portion according to the electrostatic force and display a desired color, wherein said driving means displays the desired color by applying a first voltage different from a reference voltage to said first electrode, applying a voltage which is not lower than twice the first voltage to said second electrode and applying a voltage which is not lower than the first voltage to said supporting member, and wherein said driving means holds the displayed color by applying said reference voltage to said first and second electrodes and applying a voltage different from the reference voltage to said supporting member.

2. A display device according to claim 1, wherein said actuatable portion is a film.

3. A display device according to claim 2, wherein the first color is an opaque white color and the second color is an opaque black color.

4. A display device according to claim 1, wherein the display device includes a plurality of pixel portions each of which is constructed by said fixed portion, said actuatable portion, said supporting member and said first and second electrodes and said actuatable portion moves to a position under said fixed portion of an adjacent pixel portion in response to supply of the voltage from said driving means.

5. A display device according to claim 1, wherein the display device has three sets each including said actuatable portion, said supporting member and said first and second electrodes, the second colors of the respective sets are cyan, magenta and yellow, the first color is an opaque white color, and said driving means supplies voltages to said supporting member, said first and second electrodes independently for the three sets to display a desired color.

6. A display device comprising:

a plurality of pixel portions arranged in a matrix form, each of said pixel portions including a fixed portion having a first color, an actuatable portion having a second color, a supporting member for supporting said actuatable portion, and first and second electrodes arranged with said supporting member disposed therebetween;

a plurality of first scanning lines each of which is electrically connected to said first electrodes of those of said pixel portions which lie on a corresponding one of rows;

a plurality of second scanning lines each of which is electrically connected to said second electrodes of those of said pixel portions which lie on a corresponding one of rows;

a plurality of signal lines each of which is electrically connected to said supporting members of those of said pixel portions which lie on a corresponding one of columns; and driving means for applying voltages to said plurality of signal lines and said plurality of first and second scanning lines according to a video signal to generate electrostatic forces from said first and second electrodes with respect to said supporting members in said pixel portions and deforming said supporting members to move said actuatable portions on said fixed portions according to the electrostatic forces and display a desired video image, wherein said driving means displays the desired video image by applying a first voltage different from a reference voltage to at least one desired first scanning line among said plurality of first scanning lines, applying a voltage which is not lower than twice the first voltage to at least one desired second scanning line among said plurality of second scanning lines and applying a voltage which is not lower than the first voltage to at least one desired signal line among said plurality of signal lines, and wherein said driving means holds the displayed video image by applying said reference voltage to said plurality of first and second scanning lines and applying a voltage different from the reference voltage to said plurality of signal lines.

7. A display device according to claim 6, wherein said actuatable portion is a film.

8. A display device according to claim 7, wherein the first color is an opaque white color and the second color is an opaque black color.

9. A display device according to claim 6, wherein said actuatable portion moves to a position under said fixed portion of an adjacent pixel portion in response to supply of the voltage from said driving means.

10. A display device according to claim 6, wherein each of said plurality of pixel portions has three sets each including said actuatable portion, said supporting member and said first and second electrodes, the second colors of the respective sets are cyan, magenta and yellow, the first color is an opaque white color, the display device includes three sets corresponding to said three sets and each including said plurality of first scanning lines, said plurality of second scanning lines and said plurality of signal lines, and said driving means supplies voltages to said plurality of first scanning lines, said plurality of second scanning lines and said plurality of signal lines independently for the three sets to display the desired video image.

11. A display device according to claim 6, wherein said plurality of supporting members and said signal lines connected thereto are formed of the same member having no joint portion for each of the columns and a direction in which said actuatable portion moves by deformation of said supporting member is substantially parallel to the lengthwise direction of said signal lines.

12. A display device comprising:

a plurality of pixel portions arranged in a matrix form, each of said pixel portions including a fixed portion having a first color, an actuatable portion having a second color, a supporting member for supporting said actuatable portion, and an electrode arranged near said supporting member;

a plurality of scanning lines each of which is electrically connected to said electrodes of those of said pixel portions which lie on a corresponding one of rows;

a plurality of signal lines each of which is electrically connected to said supporting members of those of said pixel portions which lie on a corresponding one of columns; and driving means for applying voltages to said plurality of signal lines and said plurality of scanning lines according to a video signal to generate electrostatic forces from said electrodes with respect to said supporting members in said pixel portions and deforming said supporting members to move said actuatable portions on said fixed portions according to the electrostatic forces and display a desired video image, wherein said driving means displays the desired video image by applying a voltage $V_1$ to at least one desired scanning line among said plurality of scanning lines and applying one of a voltage $V_0$ and the voltage $-V_1$ to at least one desired signal line among said plurality of signal lines, and wherein said driving means holds the displayed video image by applying said voltage $V_0$ to said plurality of scanning lines and applying one of the voltage $V_0$ and said voltage $-V_1$ to said plurality of signal lines in a case where the amount of deformation of said supporting member becomes maximum when the voltage $V_0$ is applied to said electrode and the voltage 2V, is applied to said supporting member.

13. A display device according to claim 12, wherein said actuatable portion is a film.

14. A display device according to claim 12, wherein the first color is an opaque white color and the second color is an opaque black color.

15. A display device according to claim 12, wherein said actuatable portion moves to a position under said fixed portion of an adjacent pixel portion in response to supply of the voltage from said driving means.

16. A display device according to claim 12, wherein each of said plurality of pixel portions has three sets each including said actuatable portion, said supporting member and said electrode, the second colors of the respective sets are cyan, magenta and yellow, the first color is an opaque white color, the display device includes three sets corresponding to said three sets and each including said plurality of scanning lines and said plurality of signal lines, and said driving means supplies voltages to said plurality of scanning lines and said plurality of signal lines independently for the three sets to display the desired video image.

17. A display device according to claim 12, wherein said plurality of supporting members and said signal lines connected thereto are formed of the same member having no joint portion for each of the columns and a direction in which said actuatable portion moves by deformation of said supporting member is substantially parallel to the lengthwise direction of said signal lines.

18. A display device comprising:

a plurality of pixel portions arranged in a matrix form, each of said pixel portions including a fixed portion having a first color, an actuatable portion having a second color, a supporting member for supporting said actuatable portion, and first and second electrodes arranged with said supporting member disposed therebetween;

a plurality of first scanning lines each of which is electrically connected to said first electrodes of those of said pixel portions which lie on a corresponding one of rows;

a plurality of second scanning lines each of which is electrically connected to said second electrodes of those of said pixel portions which lie on a corresponding one of rows;

a plurality of signal lines each of which is electrically connected to said supporting members of those of said pixel portions which lie on a corresponding one of columns; and driving means for applying voltages to said plurality of signal lines and said plurality of first and second scanning lines according to a video signal to generate electrostatic forces from said first and second electrodes with respect to said supporting members in said pixel portions and deforming said supporting members to move said actuatable portions on said fixed portions according to the electrostatic forces and display a desired video image, wherein said driving means holds the displayed video image by applying a voltage $V_0$ to said plurality of first and second scanning lines and applying one of voltages $V_1$ and $-V_1$ to said plurality of signal lines in a case where the amount of deformation of said supporting member becomes maximum when the voltage $V_0$ is applied to one of said first and second electrodes and the voltage $2V_1$ is applied to said supporting member.

19. A display device according to claim 18, wherein said driving means applies the voltage $V_1$ to at least one desired first scanning line among said plurality of first scanning lines, applies the voltage $-V_1$ to at least one desired second scanning line among said plurality of second scanning lines and applies one of the voltage $V_1$ and the voltage $-V_1$ to at least one desired signal line among said plurality of signal lines to display a desired video image.

20. A display device according to claim 18, wherein said actuatable portion is a film.

21. A display device according to claim 20, wherein the first color is an opaque white color and the second color is an opaque black color.

22. A display device according to claim 18, wherein said actuatable portion moves to a position under said fixed portion of an adjacent pixel portion in response to supply of the voltage from said driving means.

23. A display device according to claim 18, wherein each of said plurality of pixel portions has three sets each including said actuatable portion, said supporting member and said electrode, the second colors of the respective sets are cyan, magenta and yellow, the first color is an opaque white color, the display device includes three sets corresponding to said three sets and each including said plurality of first scanning lines, said plurality of second scanning lines and said plurality of signal lines, and said driving means supplies voltages to said plurality of first scanning lines, said plurality of second scanning lines and said plurality of signal lines independently for the three sets to display the desired video image.

24. A display device according to claim 18, wherein said plurality of supporting members and said signal lines connected thereto are formed of the same member having no joint portion for each of the columns and a direction in which said actuatable portion moves by deformation of said supporting member is substantially parallel to the lengthwise direction of said signal lines.

* * * * *

UNITED STATES PATENT AND TRADEMARK OFFICE

CERTIFICATE OF CORRECTION

PATENT NO. : 6,130,656
DATED : October 10, 2000
INVENTOR(S) : Atsushi Sugahara

It is certified that error appears in the above-identified patent and that said Letters Patent is hereby corrected as shown below:

Title page,
Item [73], Assignee,
Line 1, "Toshiaba" should read -- Toshiba --.

Column 13,
Line 58, "voltage 2V," should read -- voltage $2V_1$ --.

Signed and Sealed this

Thirtieth Day of July, 2002

*Attest:*

*Attesting Officer*

JAMES E. ROGAN
*Director of the United States Patent and Trademark Office*